US008978318B2

(12) United States Patent
Klein

(10) Patent No.: US 8,978,318 B2
(45) Date of Patent: Mar. 17, 2015

(54) ERECTABLE INDOOR SHELTER

(71) Applicant: Amos Klein, Kiriat Haim (IL)

(72) Inventor: Amos Klein, Kiriat Haim (IL)

( * ) Notice: Subject to any disclaimer, the term of this patent is extended or adjusted under 35 U.S.C. 154(b) by 0 days.

(21) Appl. No.: 14/140,506

(22) Filed: Dec. 25, 2013

(65) Prior Publication Data

US 2014/0216307 A1 Aug. 7, 2014

(30) Foreign Application Priority Data

Feb. 4, 2013 (IL) ..... 224562

(51) Int. Cl.
*E04H 1/00* (2006.01)
*E04H 9/06* (2006.01)
*F41H 5/24* (2006.01)

(52) U.S. Cl.
CPC ... *E04H 9/06* (2013.01); *F41H 5/24* (2013.01)
USPC ..... 52/71; 52/69; 52/79.1

(58) Field of Classification Search
CPC ..... E04H 1/02; E04H 1/005; E04H 6/04; E04H 1/00; E04H 1/04; E04B 1/343; E04G 21/14; E02D 27/48
USPC ..... 52/64–66, 68–71, 79.1, 79.5, 79.6, 52/79.9, 79.12, 79.14, 143, 270, 745.14, 52/122.1, 127.1, 648.1, 653.1
See application file for complete search history.

(56) References Cited

U.S. PATENT DOCUMENTS

| | | | | | |
|---|---|---|---|---|---|
| 2,006,477 | A | | 7/1935 | Pendry | |
| 2,167,557 | A | | 7/1939 | Stout | |
| 2,701,038 | A | * | 2/1955 | Mooney | 52/69 |
| 3,341,987 | A | * | 9/1967 | Johansson | 52/70 |
| 3,889,432 | A | | 6/1975 | Geihl | |
| 4,035,964 | A | | 7/1977 | Robinson | |
| 4,689,924 | A | | 9/1987 | Jurgensen | |
| 4,989,379 | A | * | 2/1991 | Suzuki | 52/66 |
| 5,345,730 | A | * | 9/1994 | Jurgensen | 52/64 |
| 5,444,944 | A | * | 8/1995 | Roelofsz | 52/64 |
| 5,493,818 | A | * | 2/1996 | Wilson | 52/71 |
| 5,761,854 | A | | 6/1998 | Johnson et al. | |
| 5,996,287 | A | * | 12/1999 | Sullivan | 52/71 |
| 6,983,567 | B2 | | 1/2006 | Ciotti | |
| 8,166,715 | B2 | | 5/2012 | De Azambuja | |
| 2002/0116878 | A1 | | 8/2002 | Ciotti | |
| 2005/0044804 | A1 | * | 3/2005 | Bin et al. | 52/79.5 |
| 2006/0048458 | A1 | * | 3/2006 | Donald et al. | 52/69 |
| 2007/0245637 | A1 | * | 10/2007 | Czyznikiewicz | 52/71 |
| 2008/0265617 | A1 | * | 10/2008 | Davidson | 296/173 |
| 2010/0269419 | A1 | * | 10/2010 | Gyory et al. | 52/79.5 |
| 2010/0287847 | A1 | * | 11/2010 | Smith | 52/79.5 |

* cited by examiner

*Primary Examiner* — Beth Stephan

(57) ABSTRACT

An erectable shelter for indoor use, providing protection against threats associated with missiles. The shelter includes: one metal frame attached to at least one of the internal walls of an apartment; six protective walls attached to the frame for forming a shelter, wherein one wall covers the opening of the frame, four other walls are hinged on the frame, and another wall is hinged on a free edge of one side wall; and at least one strut connecting at least a ceiling wall with the frame.

1 Claim, 5 Drawing Sheets

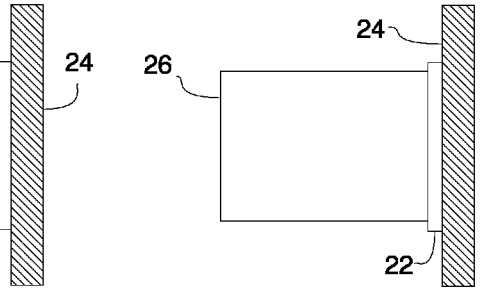
Fig. 1A
Fig. 1B
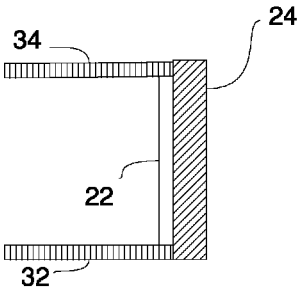
Fig. 2A
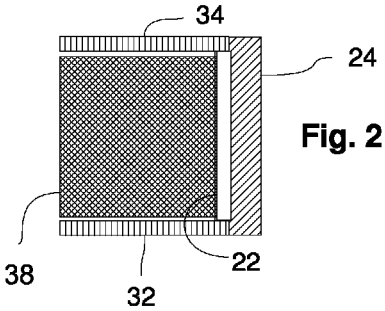
Fig. 2B
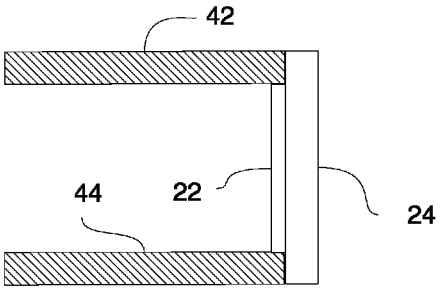
Fig. 3

ERECTABLE INDOOR SHELTER

FIELD OF THE INVENTION

The present invention is in the field of civilian security, aiming to provide protection against threats of war.

BACKGROUND OF THE INVENTION

The fact that most of the population in small and especially in large cities live in apartments and are confined to indoor living quarters, impart some limitations as regards the issue of war time protection. A missile or a projectile or a fragment of a projectile or fragments of torn masonry elements may be the cause of direct physical damage to humans or to property. Additional mechanical threat can be created as explosive charges are activated, causing blasts and fear. The aim of the present invention is to address such issues by providing protection to some degree to apartment dwellers.

SUMMARY OF THE INVENTION

The present invention relates to an erectable shelter for indoor use, providing protection against threats associated with missiles. The shelter includes: one metal frame attached to at least one of the internal walls of an apartment; six protective walls attached to the frame for forming a shelter, wherein one wall covers the opening of the frame, four other walls are hinged on the frame, and another wall is hinged on a free edge of one side wall; and at least one strut connecting at least a ceiling wall with the frame.

Other features and advantages of the instant invention will become apparent from the following description of the invention which refers to the accompanying drawings.

BRIEF DESCRIPTION OF THE DRAWINGS

FIG. 1A is a schematic top view of an erectable shelter of the invention showing a wall section and a shelter frame.

FIG. 1B is a schematic top view of an erectable shelter of the invention showing the roof wall deployed.

FIG. 2A is a schematic sectional side view of an erectable shelter of the invention showing a frame of the invention located between the ceiling and the floor of the apartment.

FIG. 2B is a schematic sectional side view of an erectable shelter of the invention showing a side wall vertically deployed.

FIG. 3 is a schematic sectional top view of an erectable shelter of the invention showing two supporting walls arrangement.

DETAILED DESCRIPTION OF THE INVENTION

Figure 4:
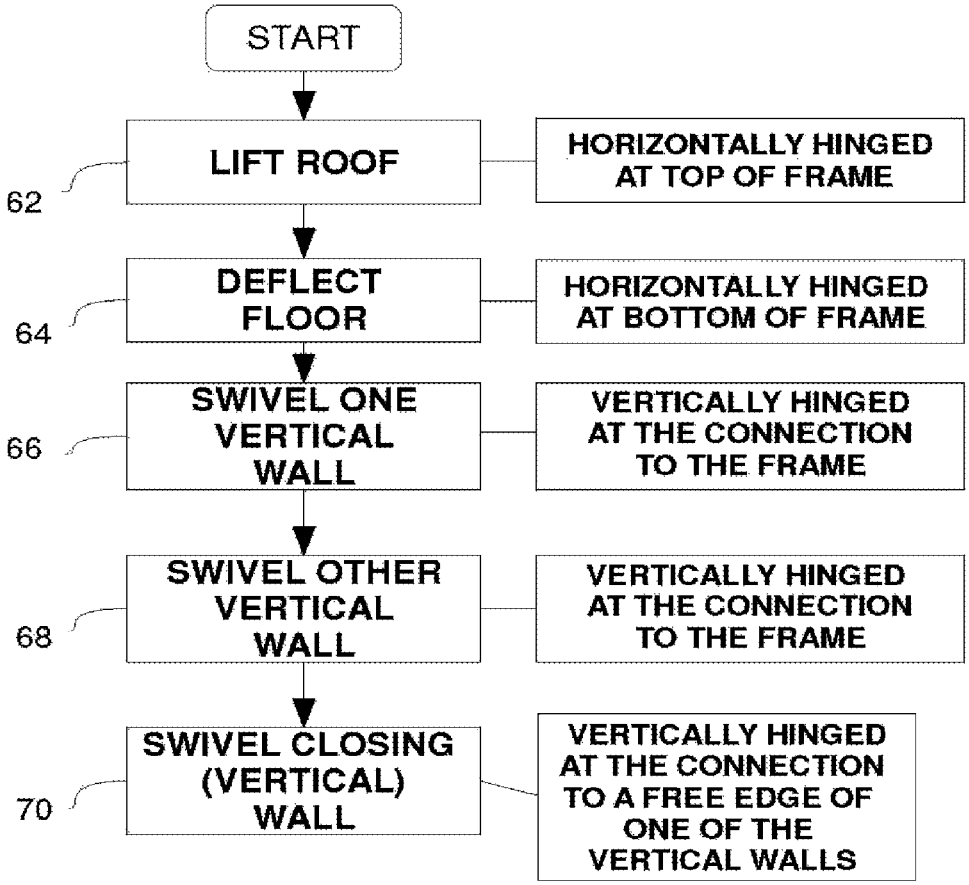
FIG. 4 is a flow chart of order of wall shelter unfolding in the course of shelter deployment with a notation, per each swiveling action where the hinged locus is, of which is the hinging orientation.

In accordance with the present invention, an unfoldable shelter is made available for inhabitants of houses or flats (apartments) inside multi-storied building or any other multi apartment living house. The basic embodiment of the invention is a packaged metal cube, or a prism having all adjacent faces at right angles to each other. The shelter can be unfolded or deployed within a room inside an apartment or a building, to form a secluded space surrounded on all the shelter's six faces by a mechanically fortified wall. In another embodiment, the foldable construction is also equipped internally, with a gas and aerosol proof enclosure.

In FIG. 1A, a schematic presentation of a non-deployed shelter is shown. In other words the shelter is folded, showing frame 22 attached to support wall 24. Looking from above, in FIG. 1B, one of the walls is unfolded, forming a roof 26. In FIGS. 2A and 2B a side view of a shelter of the invention is shown. In FIG. 2A, frame 22 is backed by support wall 24, bottom floor 32 and ceiling 34 are each a part of the building. In FIG. 2B a side wall 38 of the shelter has been pulled out (typically pivotally unfolded).

The Frame and its Anchorage

The frame 22 can be supported by the wall 38 with which an opening 48 (FIG. 8) aligns (such as support wall 24 in FIGS. 1 and 2). Alternatively, the frame 24 can be attached to two vertical walls such as walls 42 and 44 in FIG. 3 Both supports are applicable separately or together.

Inside—Out Deployment

Generally, the walls of the shelter, including the roof 26 and the floor 82, are pivotally pulled out of the frame 22, except for the one wall (i.e. rear wall), which remains covering the frame, or which could be a portion of (i.e. integrated in) the frame. Five walls are therefore swiveled out. The shelter side walls 38 are swiveled from the frame 22 each to each own side until they face each other, parallel. Then the roof 26 is swiveled upwards and the floor 82 is swiveled downwards. This order is exemplary and is summarized in the flow chart of FIG. 4. Erection typically starts by exposing the folded shelter as it is typically concealed behind a curtain or a wall carpet. In step 62, the roof 26 is pivotally lifted, usually by a handle that helps swivel the roof upwards. The roof 26 is hinged horizontally at the connection to the frame 22. In step 64 the floor 82 is deflected, swiveling at the horizontal swivel. At step 66 a first vertical wall 38 (right or left) is swiveled open sideways, hinged at one side of the frame 22. At step 68 the second vertical wall 38 is swiveled open in the other direction, being hinged at the opposite side of the frame 22, as compared to the first vertical wall. At step 70, the closing vertical wall 46 is swiveled open, being hinged at the free edge of one of the side walls 38.

Top and Bottom Faces of the Shelter

Figure 5:
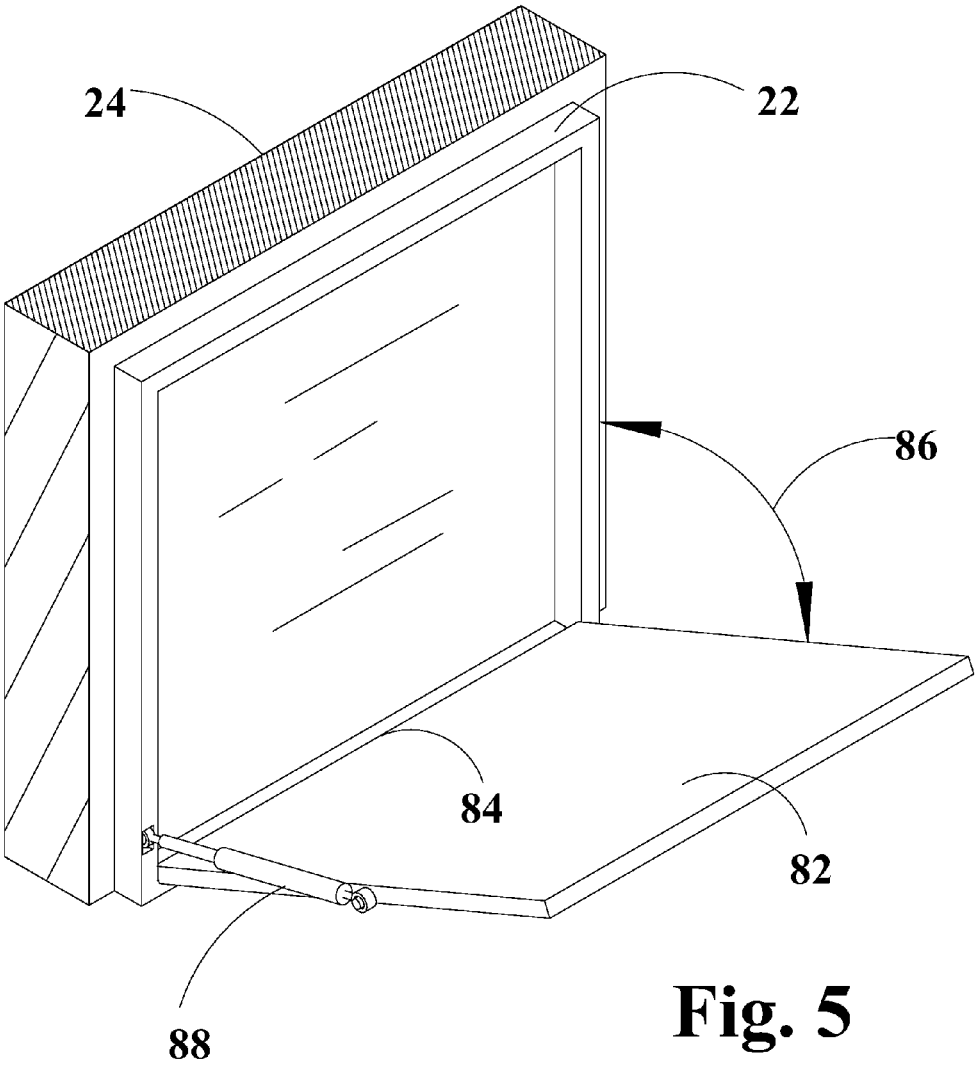
FIG. 5 is a schematic isometric view of a frame of the invention with floor in the state of deployment and a strut supporting the floor.

Reference is now made to FIG. 5, showing a floor 82 of the shelter of the invention partially deflected. Floor 82 is deflected, shown in the image departed from frame 22 swiveled at a hinge 84 (only rough zone shown). Frame 22 is supported by support wall 24 as discussed above. Double headed arrow 86 shows the swiveling direction for opening or closing. A note is made that the drawing does not fully describe a realistic view in the sense that only one wall (the floor 82) is shown, whilst the others are not shown.

To ease the unfolding of the top and bottom walls (i.e. ceiling 34 and floor 82, respectively), struts, such as struts 88 may be inserted at one or both flanks of the wall. As can be seen in FIG. 5, strut 88 connects the frame 22 with the floor 82. The struts 88 are typically gas or vacuum struts that helps lifting the roof 26 and prevents unintentional dropping. Struts 88 can be applied at both sides or only at one side (as shown in the figure) of ceiling 34 and floor 82. Typically, there are four struts 88, two for the floor 82 and two for the ceiling 34.

Windows and Openings

In the side walls 38, and in the closing vertical wall 46 (FIG. 8), hatches or larger windows may be provided, typically with shielding shutter that can be closed or opened at will typically from the inside and possibly strengthened by latches or bolts or catches that must be openable. A door is typically provided in the closing vertical wall or/and in any of the vertical walls 42 and/or 44 and is also equipped with one or more latches to secure it to the wall and/or floor 82 and/or ceiling 34.

The Walls

Figure 6:
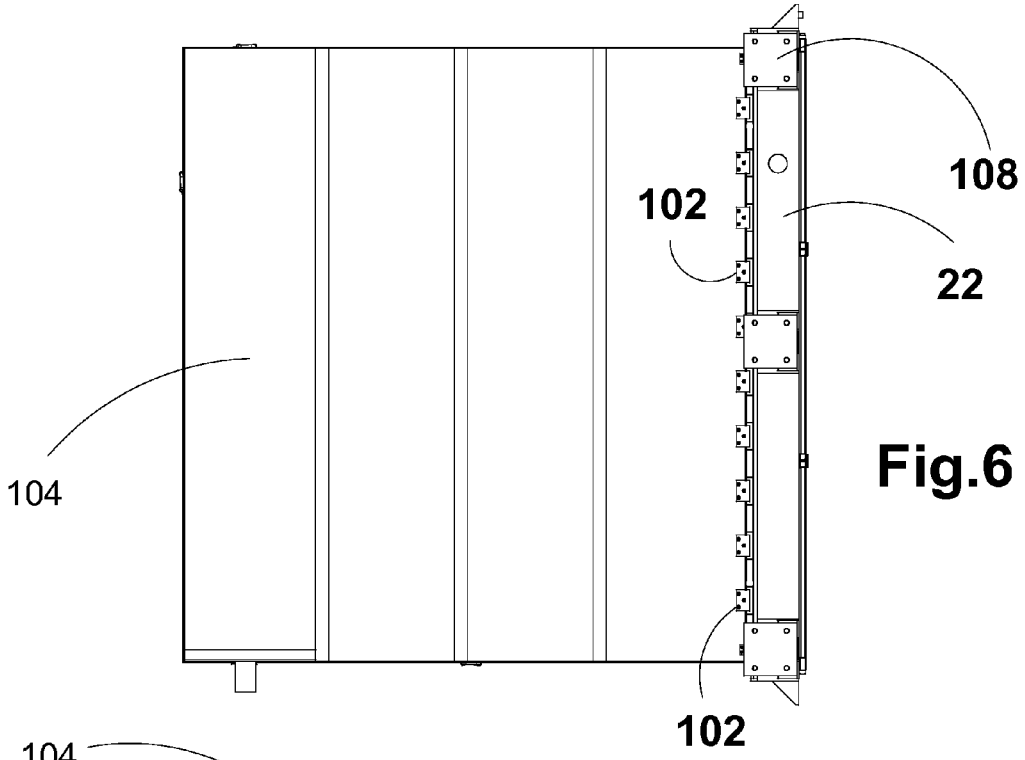
FIG. 6 is a schematic side view of a shelter in accordance with the invention showing a side wall and frame to which it connects via hinges.
Figure 7:
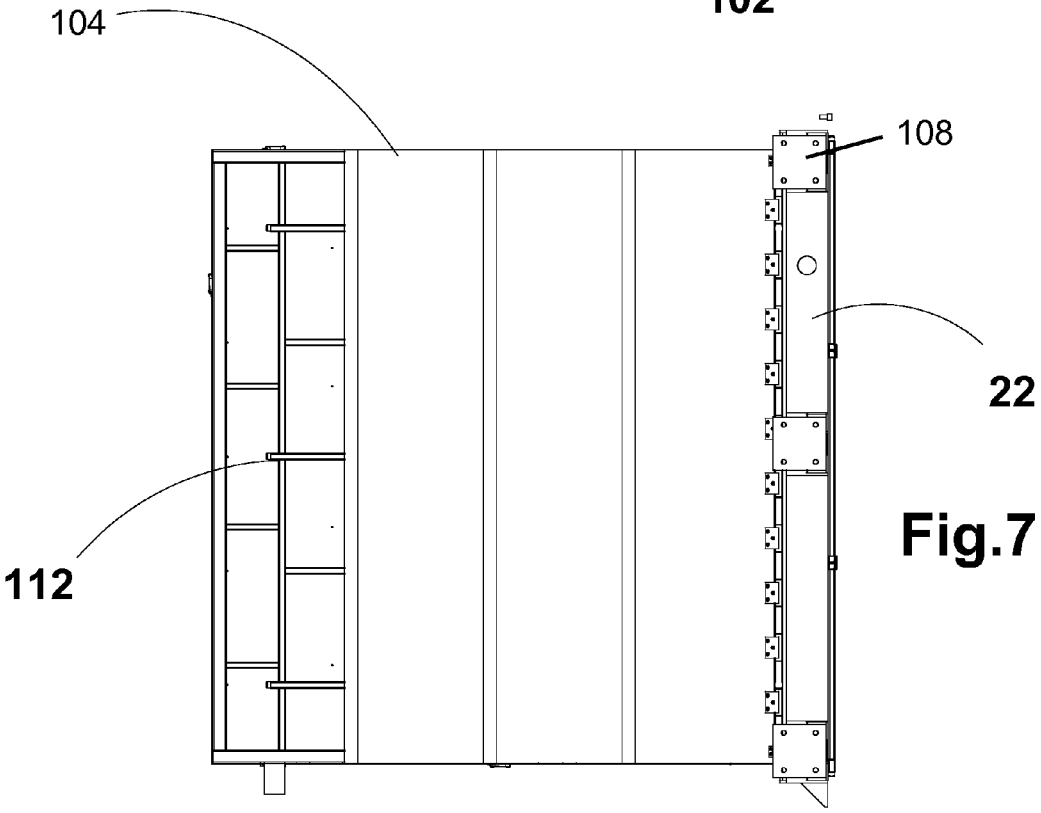
FIG. 7 is a schematic side view of a shelter as in FIG. 6, with internal wall skeleton exposed.

The walls are connected via hinges 102 to the frame 22. As can be seen in FIG. 6, frame 22 is connected by hinges 102 to a wall 104. A connecting leg 108 connects the frame 22 to a side support wall, not shown. The walls are typically made forming an internal skeleton made of metal such as hard steel, and covered by metal plates, typically inside and outside. The metal plates are typically made of steel or aluminum. This can be seen in FIG. 7, in which one of the covering plates is removed, exposing metal skeleton 112.

The side walls 38 are preferably equipped with one or more latches (not shown) to secure to the floor 32 and/or ceiling 34. Fastening the latches may also provide a way by which the walls may be drawn closer and make contact with the ceiling/floor to decrease or prevent gap formation therebetween.

Figure 8:
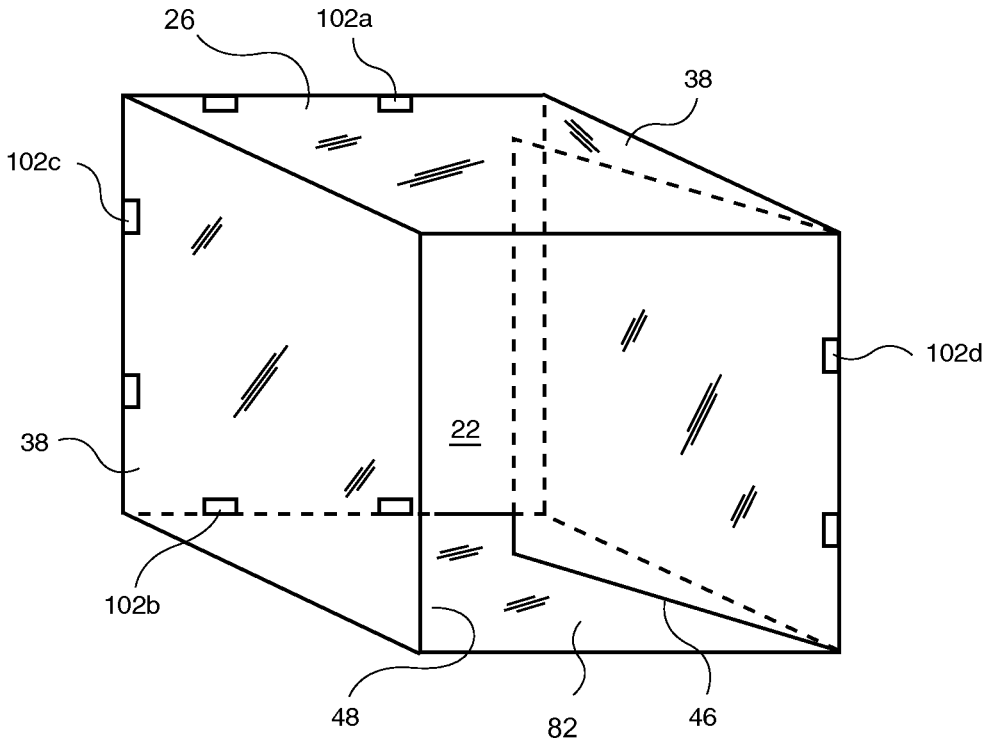
FIG. 8 is a schematic perspective view of the shelter in a nearly completely erected state.

FIG. 8 shows the shelter nearly erected. The ceiling 34 has been pivoted upward to a raised position, pivoting at its hinges 102*a*, and into place, typically with the help of the struts 88 (not visible). The floor 32 has been pivoted down, about its hinges 102*b* to a position generally parallel to the floor of the apartment. The side walls 38 have been pivoted outward, about their hinges 102*c*, so that their top edges rest under the side edges of the ceiling 34 and their bottom edges rest just above the side edges of the floor 32. The sidewalls 38 are typically then latched to the ceiling 34 and floor 32. At this point, only a front opening 48 of the shelter remains to be enclosed. Closing the front opening 48, to thus form a complete shelter, is accomplished by swinging the closing vertical wall or covering wall 46 outward in a pivoting manner at its hinges 102*d*.

Protection Provided

The shelter of the invention is to provide protection against indirect missile hits. It is to protect against the pressure shock or blast, shrapnel, projectiles such as masonry debris, falling objects and to some extent bullet and hard sharp projectiles in general.

Nuclear, Biological and Chemical (Nbc) Threat Shelter

As additional embodiment, a shelter for protecting against biological and chemical and even nuclear hazard or biological hazards (weapon or non weapon) is provided, to be installed with the shelter of the invention. This shelter of this embodiment is in the form of an erectable air tight tent, with provisions for filtering air. The tent is connected mechanically to the shelter (from the inside) using hook and loop fasteners such as VELCRO straps. Beth El Industries of 1 Avshalom Road Zikhron Yaakov, Israel provides filtration systems, such as purified air blower type LB 36 for providing purified air to such NBC shelters.

What is claimed is:

1. An erectable shelter for indoor use, providing protection against threats associated with missiles, said shelter comprising:

a shelter frame attachable to at least one internal wall of an apartment;

a ceiling pivotably attached to the shelter frame and configured to pivot upward from the frame;

a floor pivotably attached to the shelter frame and configured to pivot downward from the frame;

a pair of side walls pivotably attached to the shelter frame and configured to pivot sideways from the frame; and a covering wall pivotably attached to one of the pair of side walls, wherein the ceiling, the floor, the side walls and the covering wall are all configured, in correspondence with the shelter frame, to fold into and fold from the shelter frame.

* * * * *